United States Patent [19]

Eibe

[11] Patent Number: 4,457,155

[45] Date of Patent: Jul. 3, 1984

[54] OVERHUNG BAR ROLLING MILL STAND AND TWO-AXIS GAUGE CONTROL SYSTEM

[75] Inventor: Werner W. Eibe, Pittsburgh, Pa.

[73] Assignee: White Consolidated Industries, Inc., Cleveland, Ohio

[21] Appl. No.: 354,368

[22] Filed: Mar. 3, 1982

[51] Int. Cl.[3] ..... B21B 13/14

[52] U.S. Cl. ..... 72/241; 72/243; 72/245; 72/247

[58] Field of Search ..... 72/20, 21, 244, 245, 72/241, 242, 101, 247, 243, 8

[56] References Cited

U.S. PATENT DOCUMENTS

| | | | |
|---|---|---|---|
| 3,559,432 | 2/1971 | Rastelli | 72/21 |
| 3,587,277 | 6/1971 | Pigni et al. | 72/234 |
| 3,621,694 | 11/1971 | Greenberger | 72/226 |
| 3,818,742 | 6/1974 | Maltby et al. | 72/247 |
| 4,044,580 | 8/1977 | Worden et al. | 72/21 |
| 4,202,192 | 5/1980 | Haneda et al. | 72/21 |
| 4,203,310 | 5/1980 | Keylou et al. | 72/247 |

*Primary Examiner*—Lowell A. Larson
*Assistant Examiner*—Jorji M. Griffin
*Attorney, Agent, or Firm*—Buell, Blenko, Ziesenheim & Beck

[57] ABSTRACT

The mill stand houses a pair of upper backup rolls and a pair of lower backup rolls between which pairs the upper and lower roll drive shafts are journalled. The overhung work rolls are affixed to the ends of the drive shafts. Apparatus is provided for automatically adjusting the work rolls longitudinally, for automatically adjusting the loading on the backup rolls and for maintaining the drive shafts parallel under load. An automatic gauge control system for making the above adjustments and capable of varying the mill stand modulus or spring continuously from a stiff or constant roll gap modulus to a soft or constant pressure modulus is also described.

11 Claims, 6 Drawing Figures

OVERHUNG BAR ROLLING MILL STAND AND TWO-AXIS GAUGE CONTROL SYSTEM

This invention relates to a mill stand for a bar rolling mill and to automatic gauge control apparatus for such stand. It is more particularly concerned with a mill stand having overhung work rolls and with an automatic gauge control system which operates in two planes normal to each other.

BACKGROUND OF THE INVENTION

Bar mills of conventional design mostly consist of two multi-grooved rolls having bearing journals at each end. The bearing chocks each are held in mill housings, which are large and expensive steel castings with an elaborate screw-down mechanism for roll gap adjustment.

In order to work a rolled bar from two sides, horizontal and vertical stands are normally alternated. Both horizontal and vertical stands have to be shifted from pass to pass in accordance with rolling program changes or roll wear. In particular, the vertical roll mill stands are, therefore, of large height, especially if the rolls are overhead driven. Besides being an expensive design, they also need high and expensive buildings. In order to perform roll changes within reasonable time, the rolls are contained in cartridges or inner housings which are located in the outer housings, again an expensive set-up.

To avoid such high costs and complications, cantilevered roll mill stands have been used to some extent. With this kind of mill stand, narrow roll disks are used on overhung mounted drive shafts. These disks contain only one or sometimes two passes, which need more changing than multi-grooved rolls; however, they are more readily accessible and more easily changed.

Cantilevered roll stands of conventional design have serious limitations because the unusually heavy rolling load has to be supported in basically one bearing, the one closest to the roll disks. The bearing at the far end of the drive shaft does not contribute very much to the load distribution.

Due to rolling technology, the working rolls are limited in their maximum diameter with regard to the cross section of the bar being rolled. In order for the material to roll more into elongation instead of spread, small diameter rolls are preferred. This, on the other hand, is detrimental to the bearing capacity which demands large size bearings. In other words, the roll shafts cannot move close enough together with minimum roll diameters because of the needed large size bearings. This is the main reason why overhung type mill stands have mostly been used in the finishing and occasionally the intermediate trains of continuous bar mills where the loading is relatively light. Roughing and breakdown stands of heavy design are not being built in cantilevered fashion because of above limitations.

SUMMARY OF THE INVENTION

The mill stand of my invention has no mill housings and bearings chocks of presently known configuration. The work rolls are friction mounted or keyed to drive shafts which have no front bearings. Two backup rolls support each drive shaft in a V-type fashion. Enough bearing capacity can be accommodated in these two sets of backup rolls without any practical limitation.

Normally backup rolls support work rolls directly from above or below. However, with grooved rolls, as are required for bar rolling, the contact area between the rolls would be too small. According to my invention, the drive shafts themselves are supported, but as close to the work rolls as possible. A longer lifetime for the backup rolls can be expected before an exchange becomes necessary, because the backup rolls are completely enclosed in the housings, well lubricated and free from rolling scale.

The mill housing is of clam shell configuration, that is, the upper and lower portions of the housing each carrying a pair of backup rolls are pivoted together at one end. Rolling pressure is exerted between the other ends of the housings. Work roll adjustment is simple as both work rolls move toward or away from the pass line to the same extent. With conventional mills usually one roll is adjustable, which makes working a so-called target mill with fixed bar center line more difficult.

In order to compensate for even the slightest deflection and perfect pass shape, the drive shafts are preinclined towards each other by tilting the housing pivot shafts a small amount. After the anticipated rolling load is applied, the center lines of the rolls become parallel again.

Adjustment of the work rolls longitudinally of the drive shafts is accomplished by a double-acting hydraulic cylinder which moves the bearing at the far end of one drive shaft. A hydraulic cylinder positioned between the housing base and the end of the lower housing remote from the pivot levels the housings. The drive shafts are adjusted for parallelism by a balanced wedge arrangement described more fully hereinafter.

An automatic gauge control system which acts in two planes at 90° to each other is also employed. The work rolls are made adjustable with regard to thickness and width of the bar by servo valve controlled hydraulic cylinders. Position and pressure signals for the work roll adjusting means are provided by position and pressure transducers respectively. My control system is capable of varying the mill stand modulus or spring from stiff or constant roll gap to soft or constant pressure.

BRIEF DESCRIPTION OF THE DRAWINGS

An embodiment of my invention presently preferred by me is shown in the attached Figures in which.

DESCRIPTION OF MY PREFERRED EMBODIMENT

Figure 2:
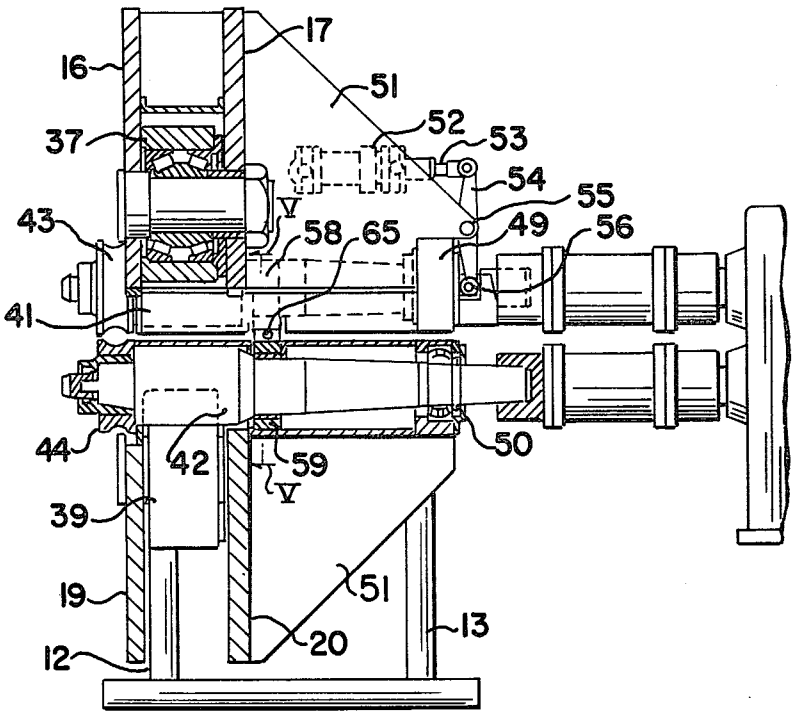
FIG. 2 is a vertical cross section taken on the plane II—II of FIG. 1.
Figure 1:
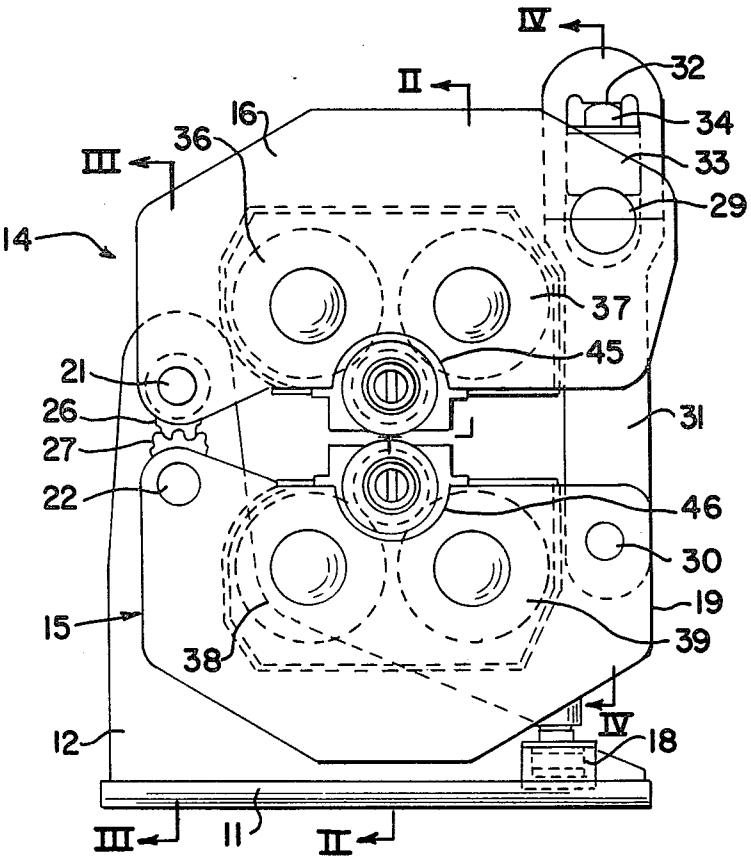
FIG. 1 is an elevation of a mill stand of my invention.

My mill stand is mounted on a flat base plate 11 to which are affixed a front upright member 12 and a rear upright member 13 spaced from member 12. The clam shell mill housing comprises an upper member 14 and lower member 15, the upper member 14 including front plate 16 and rear plate 17 spaced therefrom and the lower member 15 including front plate 19 and rear plate 20 spaced therefrom. Upper plates 16 and 17 are affixed to a cross shaft 21 at one lower corner of each and lower plates 19 and 20 are affixed to a cross shaft 22 at a corresponding upper corner of each. A hydraulic cylinder 18 is positioned between base 11 and the bottom corner of lower housing 15. Cross shaft 21 is journalled at one end in front upright 12 and at the other end in bearing 24 in rear upright 13. Cross shaft 22 is likewise journalled at one end in front upright 12 and at its other end in bearing 25 in rear upright 13. Shims 28 are positioned between bearings 24 and 25 to adjust their spacing from each other. Cross shaft 21 carries between plate 16 and 17 a gear segment 26 and cross shaft 22 carries between plates 19 and 20 a like gear segment 27 which meshes with gear segment 26. At their ends opposite the cross shafts above mentioned upper plates 16 and 17 are affixed to a pin 29 in spaced relation and lower plates 19 and 20 are affixed to a pin 30 in like spaced relation. A vertical arm 31 journals pin 30 at its lower end. Its upper end is formed with a vertically elongated opening through which pin 29 passes with clearance. The inside top surface of the elongated opening is formed into a downwardly facing flat anvil 32 and between that anvil and pin 29 is positioned a hydraulic cylinder 33 with piston 34.

Upper backup rolls 36 and 37 are journalled in upper housing 14 and lower backup rolls 38 and 39 are journalled in lower housing 15, the upper and lower rolls being closely spaced from each other side-by-side so that the bights of the upper and lower backup rolls pairs face each other. Upper drive shaft 41 is positioned in the bight of upper backup rolls 36 and 37 and lower drive shaft 42 is positioned in the bight of the lower backup rolls 38 and 39, those backup rolls forming the front bearings for those drive shafts. On the end of drive shaft 41 adjacent front plate 16 is fixed an upper grooved work roll 43 and on the end of drive shaft 42 adjacent front plate 19 is fixed a lower grooved work roll 44 in vertical alignment with upper work roll 43. The lower edge of upper front plate 16 is cut away in a semi-circle at 45, clearing work roll 43, and the upper edge of the lower front plate 19 is cut away in the same manner at 46, clearing work roll 44, so that the drive shafts 41 and 42 respectively of those work rolls are supported by their respective backup rolls 36 and 37, and 38 and 39, immediately adjacent the work rolls. The other ends of the drive shafts 41 and 42 are journalled in bearings 49 and 50 respectively. Bearing 50 is mounted on flange plate 57 affixed to back plate 20 of lower housing 15 and bearing 49 is mounted on flange plate 51 affixed to back plate 17 of upper housing 14 so as to allow a limited movement along the axis of drive shaft 41. That shaft is captive in bearing 49. Longitudinal movement of bearing 49 and drive shaft 41 is effected by double acting hydraulic cylinder 52, the closed end of which is attached to flange plate 51. Piston 53 of cylinder 52 is pivotally attached to an end of a lever arm 54, which itself is pivoted at 55 intermediate its ends on flange plate 51. The other end of arm 54 is pivotally connected to bearing 49 at 56. The ends of drive shafts 41 and 42 projecting beyond bearings 49 and 50 are connected to conventional drive spindles and other mill driving mechanism, not shown.

Figure 5:
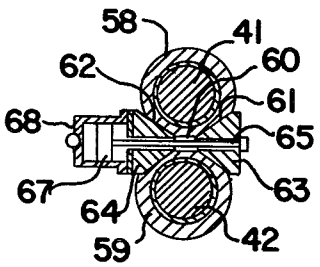
FIG. 5 is a partial vertical cross section taken on the plane V—V of FIG. 2.
Figure 4:
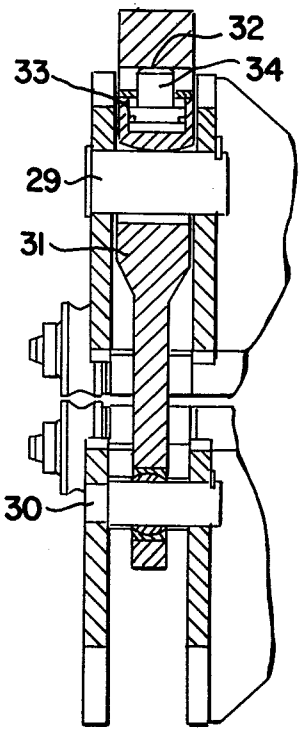
FIG. 4 is a partial vertical cross section taken on the plane IV—IV of FIG. 1.
Figure 3:
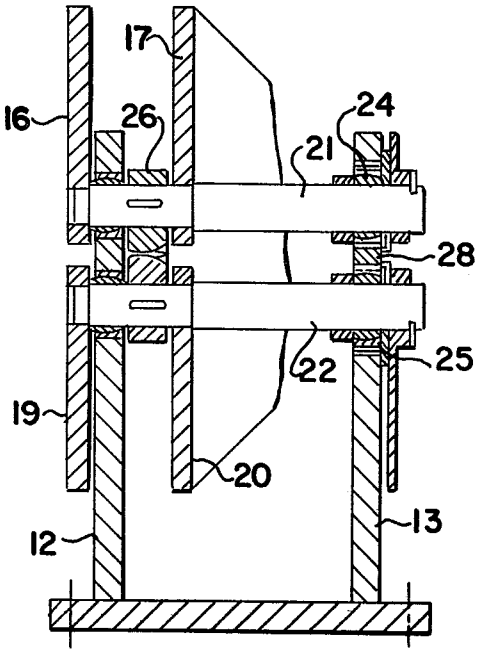
FIG. 3 is a vertical cross section taken on the plane III—III of FIG. 1.

Drive shafts 41 and 42 rotate in spaced upper sleeve 58 and lower sleeve 59, respectively, positioned adjacent plates 17 and 20 respectively. The facing portions of the sleeves are flat bottom V's, as shown in FIG. 5. Sleeve 58 has a flat bottom 60 and plane bottom faces 61 and 62 sloping upwardly and away from the ends of flat bottom 60 and sleeve 59 has a complementary shape. A wedge 63 is fitted into the wedge-shaped opening between face 61 of sleeve 58 and the oppositely inclined complementary face 63 of sleeve 59 and a like wedge 64 is fitted into the similar opening opposite thereto. A shaft 65 attached to wedge 63 passes through a hole with clearance in wedge 64 between the plane faces of sleeves 58 and 59 and is connected to the piston 67 of a hydraulic cylinder 68. Wedges 64 and 63 are captive between sleeves 58 and 59 with respect to movement longitudinally of shafts 41 and 42.

OPERATION OF PREFERRED EMBODIMENT

The position of the pass line of my mill stand is adjusted by admitting fluid to hydraulic cylinder 18 or releasing fluid therefrom as required, thus rotating lower housing member 15 one way or the other around cross shaft 22. Shims 28 are inserted around bearings 24 and 25 to cause the spacing of shafts 21 and 22 journalled therein to be somewhat less than the spacing between the other ends of those shafts when the mill stand is unloaded. When load is applied to the mill shafts 21 and 22 become parallel.

Work roll 43 is brought into axial alignment with work roll 44 by the operation of hydraulic cylinder 52. Load is applied to the work rolls by cylinder 33 and is transmitted by upper backup rolls 36 and 37 to drive shaft 41 positioned in their bight, as well as by lower backup rolls 38 and 39 to drive shaft 42 positioned in their bight. The load is thus supplied immediately adjacent work rolls 43 and 44. Drive shafts 41 and 42 are maintained parallel under load by adjustment of captive wedges 64 and 64 between upper and lower sleeves 58 and 59. This adjustment is effected by hydraulic cylinder 68 which moves opposing wedges 64 and 65 toward or away from each other.

AUTOMATIC CONTROL SYSTEM

Figure 6:
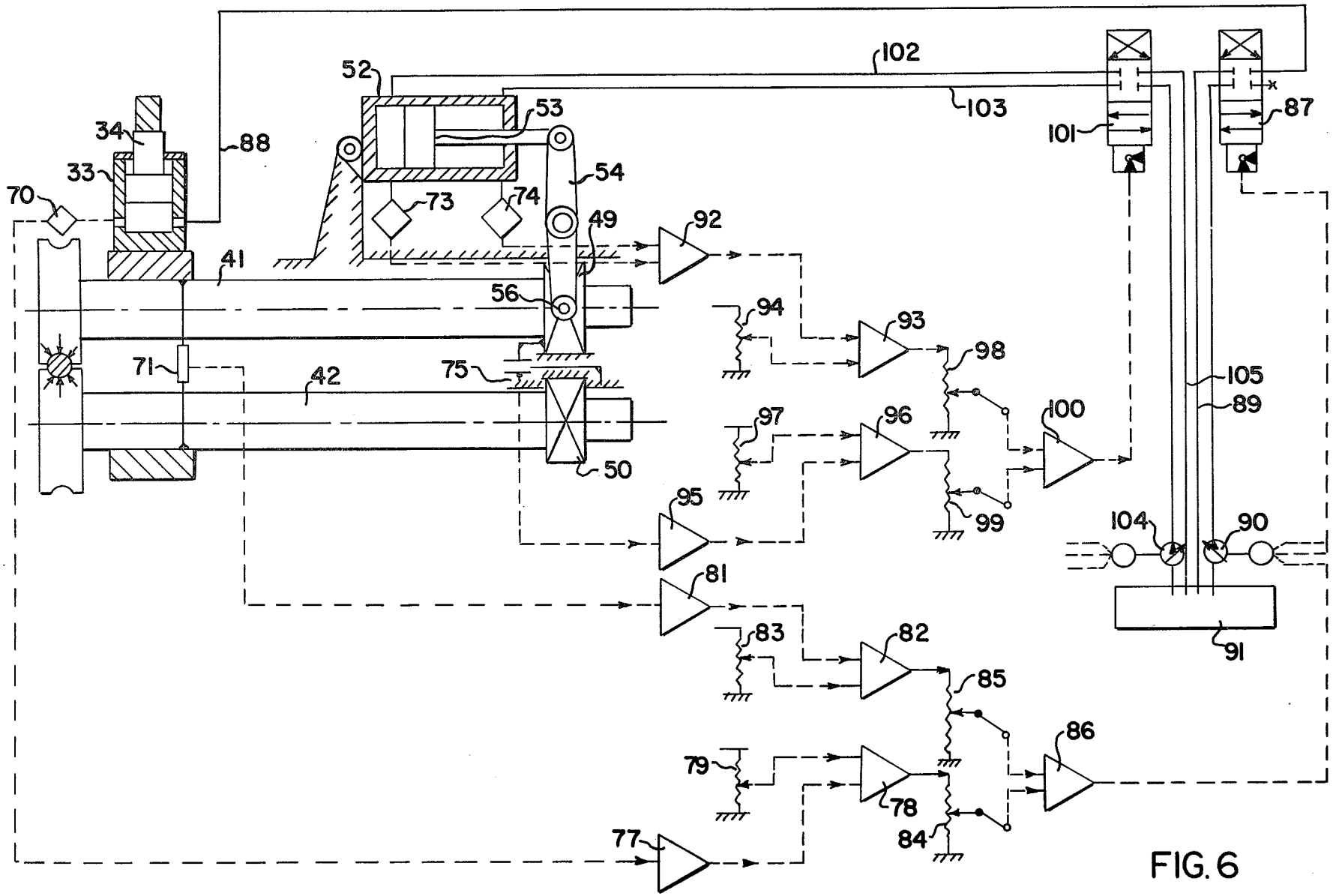
FIG. 6 is a schematic of my automatic gauge control system.

My automatic control system which acts in two planes normal to each other is shown schematically in FIG. 6. A pressure transducer 70 is connected to hydraulic cylinder 33 and a linear or position transducer 71 is connected between upper drive shaft 41 and lower drive shaft 42 in the upper and lower backup rolls. A pressure transducer 73 is connected to double acting hydraulic cylinder 52 at its closed end and a pressure transducer 74 is connected to that cylinder at its piston rod end. A linear or position transducer 75 is connected between bearings 49 and 50 so as to measure longitudinal displacement therebetween. The electrical output of pressure transducer 70 is passed through a signal conditioner 77 to one input of preamplifier 78. The other input of that preamplifier is connected to adjustable position reference voltage source 79. The electrical output of position transducer 71 is passed through a signal conditioner 81 to one input of preamplifier 82, the other input of which is connected to an adjustable position reference voltage source 83. The outputs of preamplifiers 78 and 82 are connected across adjustable voltage dividing networks 84 and 85 respectively, the sliders of which are connected to the input terminals of servo amplifier 86. Its output is connected to single-acting servo valve 87 which in one position connects pump 90 through conduit 88 to single acting hydraulic cylinder 33 and in its other position allows hydraulic fluid from that cylinder to drain through conduit 89 to tank 91.

Pressure transducers 73 and 74 are connected to the inputs of balanced signal conditioner 92, the output of which is connected to one input of preamplifier 93. The other input of that preamplifier is connected to an adjustable pressure reference voltage source 94. The output of position transducer 75 is passed through signal conditioner 95 to one input of preamplifier 96. The other input of that preamplifier is connected to adjustable position reference voltage source 97. The outputs of preamplifiers 93 and 96 are connected to adjustable voltage dividing networks 98 and 99 respectively, the sliders of which are connected to the inputs of servo amplifier 100. The output of that amplifier is connected to servo valve 101 which passes hydraulic fluid from pump 104 through conduit 102 or 103 into the closed or piston rod end respectively of double-acting hydraulic cylinder 52 and allows hydraulic fluid from either of those conductors to drain into tank 91 through conduit 105.

OPERATION OF AUTOMATIC CONTROL SYSTEM

The operation of my automatic control apparatus above described will be evident from the description. When position transducer 71 indicates an increase in the spacing between shafts 41 and 42 adjacent the rolls over that desired, preamplifier 82 receives a signal therefrom and transmits it to servo amplifier 86 which in turn actuates servo valve 87 so as to connect pump unit 90 to conduit 88. The resulting increase in pressure in hydraulic cylinder 33 causes pressure transducer 70 to send a signal through preamplifier 78 to servo amplifier 86, which then causes servo valve 87 to shut off the supply of fluid to conduit 88 and connect that conduit through conduit 89 to tank 91. If position transducer 71 signals a decrease in the drive shaft spacing my apparatus acts in the opposite direction. In like fashion, the signals from position transducer 75 maintain bearings 49 and 50 their work rolls 43 and 44 in alignment in the vertical plane. If bearing 49 is moved toward the mill stand the signal from position transducer 75 is passed through preamplifier 96 to one input of servo amplifier 100 which in turn activates servo valve 101 to connect pump unit 104 through conduit 103 to the piston rod end of cylinder 52. Piston 53 then moves toward the mill stand and lever arm 54 moves bearing 49 away from the mill stand. This movement brings about an increase in the signal from pressure transducer 73 and a decrease in the signal from pressure transducer 74, the resulting signal through preamplifier 93 to servo amplifier 100 initiating corrective action to prevent overshoot of bearing 49. The opposite signal from position transducer 75 causes bearing 49 to move away from the mill stand in like manner.

My automatic control system above described is useful for continuously varying the spring or modulus of my mill described herein, and other types of rolling mills, from a constant roll gap or stiff modulus to a constant pressure or soft modulus.

As it is known, a position controlled cylinder will hold a set piston position measured by a linear transducer against a reference setting, by permitting the pressure to vary. In case of a rolling mill application, this will permit a stiff mill spring or modulus holding a constant gap between the rolls disregarding the pressure changes. A pressure controlled cylinder will hold a set pressure measured by a pressure transducer against a reference setting by permitting the position to vary. In case of a rolling mill application, this will permit a soft mill spring or modulus holding a constant pressure between the rolls disregarding the position changes.

A bar rolling mill has several stands arranged in tandem, all rolling simultaneously on a bar product. It is desirable to be able to change both the vertical and horizontal mill modulus of some of the stands from a stiffer to a softer mode or vice versa. It may also be desirable for a constant gap controlled bar mill stand to yield some stiffness against excessive overpressure in either the vertical or horizontal rolling planes or both. A colder tail end of a bar, for instance, could badly overfill the roll groove if held very stiff under constant gap control. The resulting fins would make this portion of a bar unusable and even cause a cobble or wreck. The two-axis automatic gage control system in FIG. 6 permits the change of mill modulus from between very stiff to very soft. This is achieved by combining partial voltage signals from both position and pressure transducer preamplifiers via voltage dividing networks into the servo amplifier. To operate cylinder 33 under position control only the slider of voltage divider 85 is moved to a position at or near its maximum and the slider of voltage divider 84 is moved to its zero position.

A reference roll gap is set at position reference setpoint 83. Any deviation from this setting is sensed by position transducer 71, conveyed through signal conditioner 81 to preamplifier 82. The error signal resulting from summing against setpoint voltage 83 is conveyed at full strength through voltage divider 85 to servo amplifier 86 which opens the servo valve 87 to full system pressure. Piston 34 will move in proper direction bringing the error signal out of preamplifier 82 back to zero which closes the servo valve 87. During this position correction, the pressure loop starting from transducer 70 is made ineffective by setting voltage divider 84 at zero. To operate cylinder 33 under pressure control only the slider of voltage divider 85 is moved to its zero position and the slider of voltage divider 84 is moved to a position at or near its maximum. A reference pressure is set at pressure reference set point 79.

A signal from pressure transducer 70 is conveyed through signal conditioner 77 to preamplifier 78. The error signal resulting from summing against pressure setpoint 79 is conveyed at full strength through voltage divider 84 to servo amplifier 86 which controls the servo valve 87 so as to keep the selected reference pressure by reducing the error signal out of preamplifier 78 to zero. During this pressure correction, the position loop starting from linear transducer 71 is made ineffective by setting voltage divider 85 at zero. The automatic controls for cylinder 52 operate in the same way. As that cylinder is necessarily double-acting, it requires two pressure transducers, and signal conditioner 92 is balanced to provide a single output corresponding to the differential pressure between transducers 73 and 74. Pressure is kept on both sides of piston 53 establishing a desired differential pressure between transducers 73 and 74 which is summed in signal conditioner 92 and compared against reference pressure setpoint 94. The position loop starting with transducer 75 is equivalent to the one starting with position transducer 71 described above.

In the foregoing specification, I have set out certain preferred practices and embodiments of my invention, however, it will be understood that this invention may be otherwise embodied within the scope of the following claims.

I claim:

1. An overhung bar mill comprising upper and lower roll housings, upper and lower pairs of backup rolls journalled in the upper and lower roll housings respectively, upper and lower drive shafts positioned in the bights of the upper and lower pairs of backup rolls respectively in pressure-transmitting relation therewith and with each other, upper and lower overhung rolls affixed to the ends of the upper and lower drive shafts respectively adjacent the backup rolls, and vertical loading means connected between the upper and lower housings.

2. Apparatus of claim 1 including a base and means for pivotally mounting the upper and lower roll housings on the base.

3. Apparatus of claim 2 in which the means for pivotally mounting the upper and lower roll housings comprise separate shafts having meshing gear segments affixed thereto.

4. Apparatus of claim 2 in which the means for pivotally mounting the upper and lower roll housings comprise separate shafts extending beyond the housings and means positioned between the extended ends of the shafts for inclining those shafts toward each other at those ends to compensate for shaft deflection when load is applied to the housings.

5. Apparatus of claim 2 including means connected between the base and the lower housing for effecting movement of that housing about its pivotal mounting on the base.

6. Apparatus of claim 1 in which the vertical loading means comprise a vertical arm pivotally connected at one end to one housing and having a vertically elongated eye at its other end, a pivot shaft fixed in the other housing passing through the eye, and means positioned between the pivot shaft and the end of the eye for exerting pressure therebetween.

7. Apparatus of claim 1 including a pair of sleeves surrounding the upper and lower drive shafts respectively on the drive side of the housing adjacent the backup rolls, those sleeves having spaced apart facing flat bottomed V-shaped peripheries, a pair of wedges fitted into the wedge-shaped gaps between those sleeve peripheries, one on each side, a shaft affixed to one wedge and passing through the other wedge in the space between the flat bottoms of the sleeves, and means attached to the other wedge for moving that shaft so as to vary the spacing between the sleeves.

8. Apparatus of claim 1 including double-acting loading means mounted on the base for longitudinally moving one drive shaft with respect to the other drive shaft to align the rolls.

9. Apparatus of claim 8 including a first load measuring transducer connected to the vertical loading means, second and third load measuring transducers connected to each end respectively of the double-acting loading means, a first position measuring transducer connected to measure vertical displacement between the upper and lower work rolls, a second position measuring transducer connected to measure longitudinal displacement between the upper and lower work rolls, vertical adjusting means connected with the vertical loading means, longitudinal adjusting means connected with the double-acting loading means, means connecting the first load measuring transducer and the first position measuring transducer to the vertical adjusting means so as to maintain the vertical spacing between the work rolls at a predetermined value, and means connecting the second and third load measuring transducers and the second position measuring transducer to the longitudinal adjusting means so as to maintain the longitudinal displacement between the work rolls at a predetermined value.

10. Apparatus of claim 9 in which the vertical loading means and the longitudinal loading means are hydraulic means and the vertical and longitudinal adjusting means comprise a hydraulic fluid supply means, a single-acting servo valve connecting those supply means with the vertical loading means, a double-acting servo valve connecting those supply means with the respective ends of the double-acting loading means, a first servo amplifier connected to the single-acting servo valve and a second servo amplifier connected to the double-acting servo valve, means connecting the first load measuring transducer and the first position measuring transducer with the first servo amplifier, and means connecting the second and third load measuring transducers and the second position measuring transducer with the second servo amplifier.

11. The method of rolling a hot bar in grooved rolls of an overhung mill stand comprising simultaneously and automatically measuring the vertical movement of the rolls during rolling at the overhung side of the mill stand, measuring the horizontal movement of the rolls during rolling at the drive side of the mill stand, adjusting the vertical mill modulus at the overhung side of the mill stand in response to the vertical movement only and adjusting the horizontal mill modulus at the drive side of the mill stand in response to the horizontal movement only so as to maintain uniform cross section from end-to-end of a rolled bar subject to differential cooling.

* * * * *

UNITED STATES PATENT AND TRADEMARK OFFICE

CERTIFICATE OF CORRECTION

PATENT NO. : 4,457,155

DATED : July 3, 1984

INVENTOR(S) : Werner W. Eibe

It is certified that error appears in the above-identified patent and that said Letters Patent is hereby corrected as shown below:

Column 4, line 34, after wedges 64 and, change "64" to --63--.

Signed and Sealed this

*Fifth* Day of *March 1985*

[SEAL]

*Attest:*

DONALD J. QUIGG

*Attesting Officer* *Acting Commissioner of Patents and Trademarks*